United States Patent [19]

Beretta

[11] Patent Number: 4,615,134

[45] Date of Patent: Oct. 7, 1986

[54] RETAINING MECHANISM FOR RIFLE MAGAZINES

[75] Inventor: Pier G. Beretta, Gardone V.T., Italy

[73] Assignee: Fabrica d'Armi P. Beretta S.p.A., Italy

[21] Appl. No.: 670,342

[22] Filed: Nov. 9, 1984

[30] Foreign Application Priority Data

Nov. 15, 1983 [IT] Italy ..... 5220 A/83

[51] Int. Cl.[4] ..... F41C 27/00

[52] U.S. Cl. ..... 42/6; 42/7

[58] Field of Search ..... 42/6, 7, 18, 22

[56] References Cited

U.S. PATENT DOCUMENTS 2,305,033 12/1942 Roemer ..... 42/18

4,429,479 2/1984 Johnson ..... 42/6

4,521,985 6/1985 Smith et al. ..... 42/7

*Primary Examiner*—Charles T. Jordan

*Attorney, Agent, or Firm*—McGlew and Tuttle

[57] ABSTRACT

The present invention relates to a retaining mechanism for the magazine of automatic and/or semi-automatic rifles, in particular to a type of magazine which is provided with a lateral securing slot. The hook (6) which is designed to engage in the slot (4) of the magazine (3) is fixed to a spring-loaded arm (8) located transversely in the body (1) of the weapon and can be moved either by means of a button (9) attached to one end of the said arm (8) or by means of a rocking lever (12) mounted at the other end of the arm (8). The hook (6) can thus be operated from both sides of the weapon.

4 Claims, 4 Drawing Figures

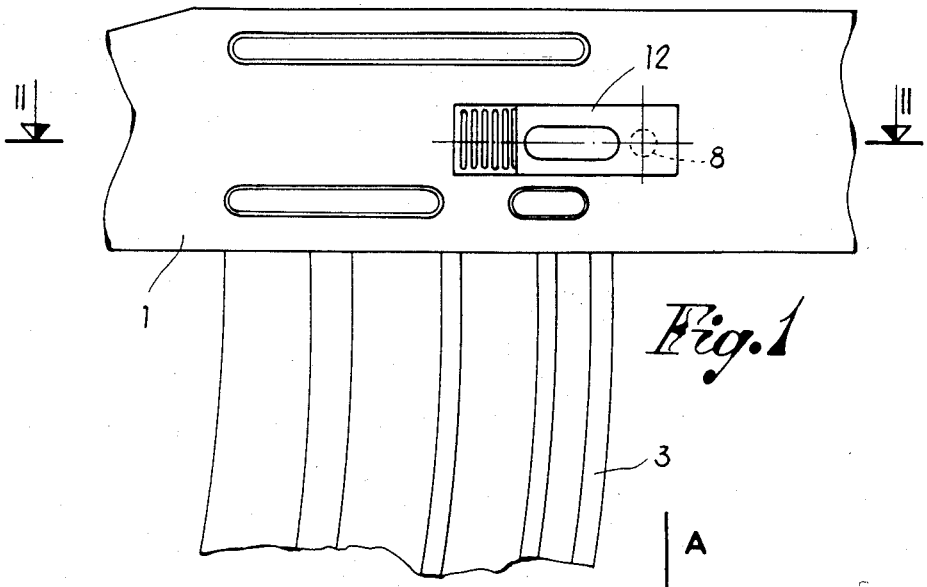
Fig. 1
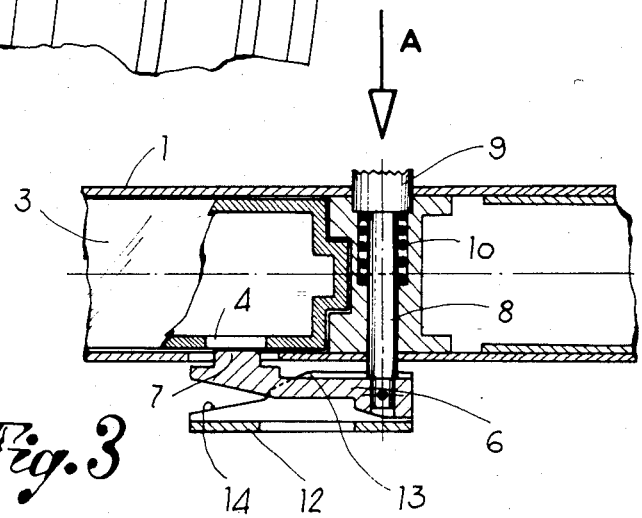
Fig. 3
Fig. 4
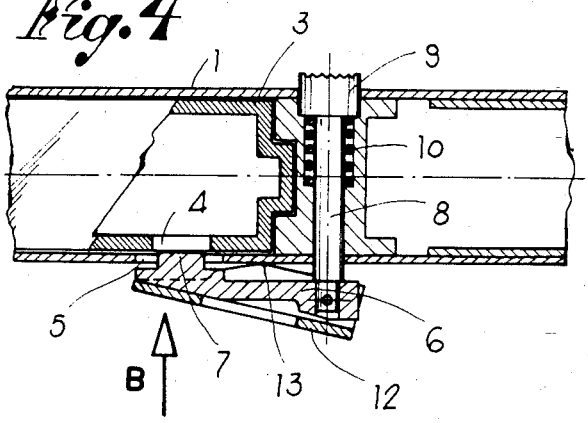

RETAINING MECHANISM FOR RIFLE MAGAZINES

The present invention relates to a retaining mechanism for the magazine of automatic and/or semi-automatic rifles.

FIELD AND BACKGROUND OF THE INVENTION

In the context of automatic and/or semi automatic rifles the use of magazines with a lateral securing slot such as the "standard NATO cal .223" is known. Correspondingly a hook for securing the magazine in the recess provided therefor in the rifle has already been proposed.

In accordance with known arrangements this hook comprises a hook member with a tooth which is designed to engage the lateral slot in the magazine and the said member is attached to one end of an arm or rod which is guided transversely through the body of the weapon and is provided with an operating push-button at the opposite end.

In practice the hooking member ends up on one side of the body of the weapon while the operating button is on the opposite side. The arm or rod is also biassed by a spring which tends to hold the hook member with the engaging tooth in the condition in which the magazine is secured; disengagement of the latter for replacement is thus achieved by pressing on the press-button to move the member away from the magazine.

It is obvious however that the hook described above can only be operated from one side of the weapon, normally the right hand side, and is therefore not convenient for anyone who uses the left hand to replace the magazine when necessary. However, in any event, if the rifle is provided with a stock which can be folded back against the rifle body, in particular on the side with the push-button operating the hook, the said push-button is difficult to reach and operate when the stock is folded so that it is difficult and inconvenient to replace the magazine.

SUMMARY OF THE INVENTION

The aim of the invention is to provide a releasable retaining mechanism for the magazine of automatic and/or semi-automatic rifles, in particular the standard NATO cal .223 magazine, which can be operated from both sides or with both hands so as to overcome the disadvantages mentioned above and to enable the magazine to be replaced easily and conveniently even when the stock of the rifle is folded back against one side of the body of the weapon.

According to the present invention there is provided a quick release retaining mechanism for magazines of automatic and/or semi-automatic rifles, in particular a magazine provided with a lateral securing slot, comprising a spring-loaded arm or rod which is guided transversely within the body of the rifle, a hook member attached to one end of the arm or rod and having a tooth which is arranged to engage in a lateral slot of a magazine upon insertion thereof and an operating push-button attached to the opposite end of the arm or rod, and wherein an auxiliary operating lever is attached to the arm or rod on the side of the rifle body remote from said push-button for enabling effecting release of the hook from either side or with either hand.

BRIEF DESCRIPTION OF THE DRAWINGS

The present invention will now be described further, by way of example, with reference to the accompanying drawings, in which:

FIG. 1 shows a lateral view of a portion of a rifle in the vicinity of the magazine and the securing hook;

FIG. 3 shows, in cross-section, the manner in which the magazine is released by pressing on a hook-operating push-button; and FIG. 4 shows a similar cross-section illustrating the manner of release using an auxiliary operating lever.

DESCRIPTION OF THE PREFERRED EMBODIMENT

Figure 2:
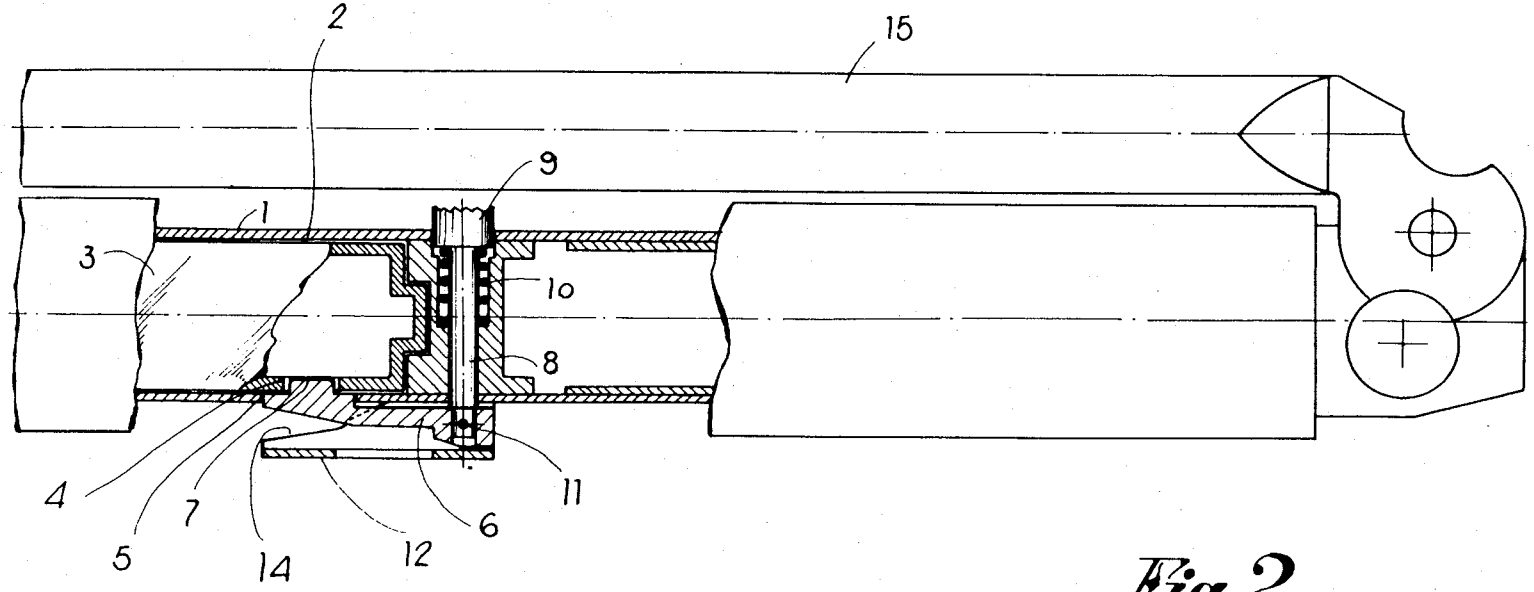
FIG. 2 shows a partial longitudinal cross-section obtained according to the arrows II—II in FIG. 1 in which the stock of the rifle is folded alongside the barrel.

In the drawings body 1 of a automatic or semi-automatic rifle is shown in which a recess 2 is provided for receiving a magazine 3 which has, in a known manner, a lateral securing slot 4, which coincides with a slot 5 made in the adjacent side of body 1.

The magazine 3 is secured in the recess 2 by a hook member 6 having a tooth 7 which is engageable in the lateral slot 4 via the lateral slot in body 1 when a magazine is inserted. Hook member 6 is secured to one end of an arm or rod 8 which is located and guided transversely through body 1 and is provided at its opposite end with an operating push-button 9. A spring 10, which normally urges hook member 6 so as to secure magazine 3 by means of tooth 7, as shown in FIG. 2 of the drawing, acts against the arm or rod 8.

The end of arm or rod 8 to which hook member 6 is attached is connected by means of a pin 11 to an auxiliary lever 12 which is on the side of body 1 remote from the operating push-button 9. The auxiliary lever 12 is of a "rocker" type and has an intermediate or cam portion 13 which is designed to act as a rocking fulcrum for the lever 12 pressing against the adjacent side of body 1, in order to release the hook. The said lever 12 also has an end pressable portion 14, which is tapered on the side facing the body 1 in order to allow the lever 12 to rock properly, although it may of course have any other desired shape as long as it performs the required function. The cam portion 13 is on legs of the lever 12 which are on opposite sides of the hook member 6 and thus at least partly surround the hook member.

As stated above, FIG. 2 of the drawing illustrates the condition in which magazine 3 is secured by tooth 7 of hook member 6, a condition which is maintained and secured by the action of spring 10.

Starting from this condition, the release of magazine 3 for removal and replacement may be brought about by operating either push-button 9 or auxiliary lever 12. In the first case, it is sufficient to press push-button 9 in the direction of arrow A in FIG. 3, in the second case it is sufficient to press on the end 14 of auxiliary lever 12 in the direction of arrow B in FIG. 4. In both cases tooth 7 is moved away from lateral slot 4 of the magazine to release it.

It is obviously possible therefore to operate the hook from both sides, or using either hand, as a result of which the hook can conveniently be operated and the magazine replaced under any circumstances, and even when the rifle is of the type with a folding stock 15 which folds against one side of the rifle body as illustrated in FIG. 2.

Auxiliary lever 12 may however be of a different shape and may be operated by pulling instead of pushing.

I claim:

1. An ambidextrous release and retaining mechanism for magazines of automatic or semi-automatic rifles, the magazines each having a lateral securing slot therein and the rifles having a body for receiving the magazines, comprising a rod guided for transverse sliding movement through the body of the rifle, said rod having opposite first and second ends extending outside the body, a spring engaged with said rod and against the body for biasing said rod in a direction toward its first end, a pushbutton connected to said first end of said rod for manually pushing said rod against the bias of said spring, a hook member having a tooth engagable in the lateral slot of a magazine in the body, said hook member being fixed to said second end of said rod, and an auxiliary lever pivotally mounted to said second end of said rod, said auxiliary lever having a cam portion engagable against a side of the body opposite from said first end of said rod, said cam portion being spaced away from said second end of said rod and said auxiliary lever having a pressable portion extending further from said second end of said rod than said cam portion so that said pressable portion can be pressed toward the body for moving said rod against the bias of said spring, movement of said rod against the bias of said spring detaching said tooth of said hook member from the lateral slot of a magazine in the body.

2. A mechanism according to claim 1 including a single pivot pin extending through said second end of said rod for fixing said hook member to said rod and for pivotally mounting said auxiliary lever to said rod.

3. A mechanism according to claim 2 wherein said auxiliary lever at least partly covers said hook member.

4. A mechanism according to claim 3 wherein said auxiliary lever has opposite legs each carrying said cam portion and lying on opposite sides of said hook member.

* * * * *